United States Patent [19]

Steding

[11] Patent Number: 4,738,568

[45] Date of Patent: Apr. 19, 1988

[54] ANTI-VACUUM APPARATUS AND METHOD FOR INSTALLING CONCRETE PILES

[76] Inventor: Jerry A. Steding, 9315 River Club Pkwy., Duluth, Ga. 30136

[21] Appl. No.: 743,574

[22] Filed: Jun. 11, 1985

[51] Int. Cl.[4] ..... E02D 5/34

[52] U.S. Cl. ..... 405/241; 405/233; 405/236

[58] Field of Search ..... 405/232, 233, 236, 240, 405/241, 242, 243

[56] References Cited

U.S. PATENT DOCUMENTS

| | | | |
|---|---|---|---|
| 858,742 | 7/1907 | Moran | 405/236 |
| 890,765 | 6/1908 | Gilbreth | 405/242 X |
| 3,152,450 | 10/1964 | Muller | 405/236 X |
| 3,608,317 | 9/1971 | Landau | 405/236 |
| 3,690,109 | 9/1972 | Turzillo | 405/241 |
| 3,851,484 | 12/1974 | Steding | 405/233 |
| 3,851,485 | 12/1974 | Steding | 405/233 |
| 4,018,056 | 4/1977 | Poma | 405/233 |

*Primary Examiner*—David H. Corbin

*Attorney, Agent, or Firm*—Hurt, Richardson, Garner, Todd & Cadenhead

[57] ABSTRACT

A concrete pile installation apparatus and method is disclosed wherein a device penetrates the soil to produce an opening for the formation of the pile. Fill material, such as grout, is introduced into the opening and a potential vacuum void created in the formation of the pile is vented to the atmosphere to prevent the pulling of surrounding soil into the opening and thereby causing the formation of a defective pile.

16 Claims, 5 Drawing Sheets

ANTI-VACUUM APPARATUS AND METHOD FOR INSTALLING CONCRETE PILES

BACKGROUND OF THE INVENTION

The present invention constitutes an improvement in the apparatus and method for installing concrete piles according to prior U.S. Pat. Nos. 3,851,484 and 3,851,485, both issued to Steding on Dec. 3, 1974.

A problem can arise during the installation of concrete piles in accordance with the apparatus and method disclosed in the above patents where soft soil below the water table is encountered and where the rate of penetration of the plow point into the soft soil is not controlled. This problem can result in the formation of imperfect concrete piles, and it is the primary object of the invention to alleviate this difficulty in a simple, effective and economical manner.

More particularly, if the pile driving hammer is allowed to strike the pusher with such force that the resulting penetration of the plow point under each hammer blow is in the order of six inches to one foot, then, at the point of impact of the pile hammer with the pusher, the plow point is temporarily driven from beneath the grout column above it, forming a void between the plow point and grout column. Such void cannot exist in actuality because of a nearly perfect vacuum therein, and therefore the void must be instantly filled either with grout from above or with the surrounding soft soil adjacent to the concrete pile being formed. The vacuum tends to pull the surrounding soft soil into the void in some cases, resulting in decreasing the diameter of the pile.

This entire problem is corrected and eliminated by the present invention simply by providing an effective vacuum relief arrangement in the apparatus being employed to form a concrete pile in soft soil below the water table or in other situations where the formation of the described vacuum could result.

Another important object of the invention is to provide a vacuum relief passage means in a concrete pile installing apparatus whose presence does not impede the normal mode of use of the apparatus to form concrete piles in accordance with the teachings of the above-referenced prior patents.

Other features and advantages of the invention will become apparent to those skilled in the art during the course of the following detailed description.

DETAILED DESCRIPTION

Figure 1:
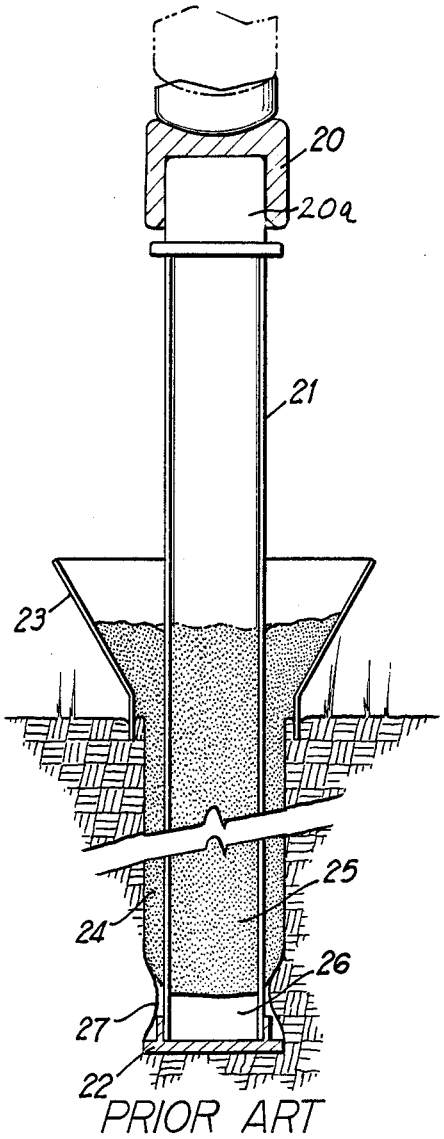
FIG. 1 is a partly schematic vertical cross section through a prior art concrete pile installing apparatus and method.

Referring to the drawings in detail wherein like numerals designate like parts, FIG. 1 depicts the prior art substantially in accordance with the above-referenced Steding patents. A drive head 20 is engaged with a drive head adapter 20A and pusher 21 which is in turn engaged at its lower end with a suitable plow point 22. A grout supply hopper 23 on the ground surface surrounds the pusher 21 to deliver grout downwardly by gravity into the bore or cavity 24 of the soil created by the advancing plow point 22 under the influence of a pile driving hammer (not shown).

As explained previously, in soft soil below the water table, unless the rate of penetration of the plow point 22 per hammer blow is controlled, the plow point will be temporarily driven away from the bottom of the grout column 25 tending to create a void 26 between the plow point and the grout column. This void cannot remain empty because of the high degree of vacuum therein and must be substantially instantly filled with grout or with the soft soil adjacent to the apparatus and the pile being installed.

As indicated by the numeral 27 in FIG. 1, the vacuum in the void 26 may pul the surrounding soft soil inwardly, thus effectively decreasing the diameter of the bore immediately behind the plow point 22 and correspondingly decreasing the cross sectional size of the concrete pile, rendering it defective.

Figure 2:
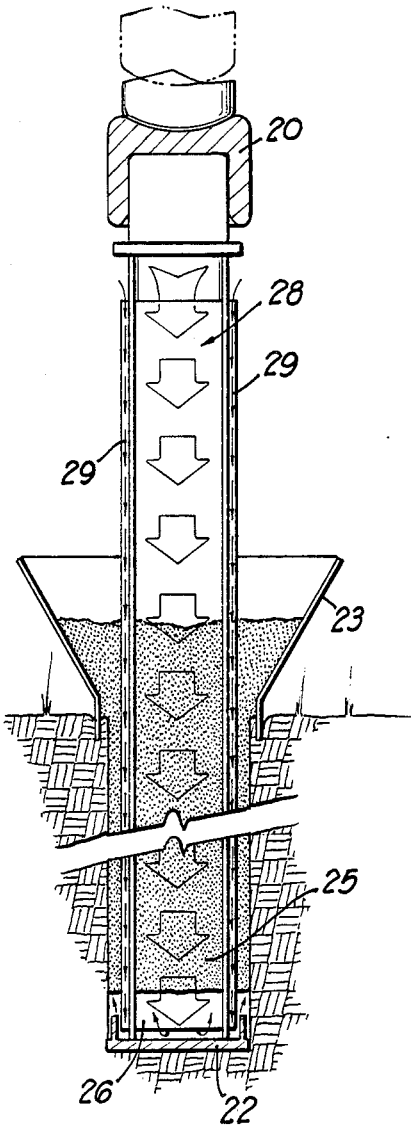
FIG. 2 is a similar view of the improved anti-vacuum apparatus and method for installing concrete piles in accordance with the present invention.

FIG. 2 depicts the complete solution of the prior art problem described in connection with FIG. 1 by means of the present invention. In FIG. 2, the same drive head 20, grout hopper 23 and plow point 22 may be employed. However, the pusher 28 according to the present invention differs from the prior art pusher 21 in that it is provided with longitudinally extending vacuum-relief passage means 29, whereby the vacuum induced in the temporary void 26 when the plow point 22 moves away from the grout column 25 is vented to atmosphere and thus effectively eliminated, so that the surrounding soft soil cannot be pulled inwardly to diminish the cross-sectional size of the concrete pile as shown in FIG. 1.

FIGS. 3 to 6 depict in greater detail a first embodiment of the invention including a pusher 30 and a plow point 31 telescopically engaged as shown. The drive head 20 and grout hopper 23 shown in FIGS. 1 and 2 are omitted in FIG. 3 for ease of illustration but these latter components are used in the method and apparatus according to FIGS. 3 to 6.

Figure 3:
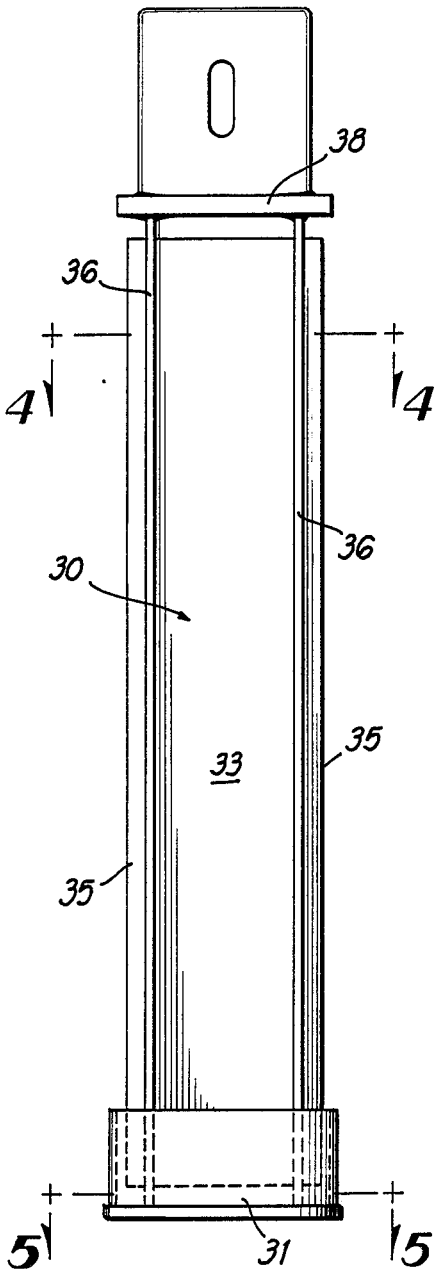
FIG. 3 is a side elevation of an assembled pusher and plow point according to one embodiment of the invention.

The plow point 31 is circular, as shown, and the pusher 30 is an H-cross section member. On opposite sides of its center web 32, pusher 30 is provided with shallow channel members 33 welded thereto defining with the web 32 a pair of opposite side vacuum-relief passages 34. Similarly, a pair of channel members 35 welded to the outer faces of the side webs 36 of the pusher define another pair of vacuum-relief passages 37 lengthwise of the pusher. As shown in FIG. 3, the channels 33 and 35 at their tops terminate short of a flange 38 near the top of the pusher. Therefore, the tops of the passages 37 are open to atmosphere below the flange 38 as are the tops of the passages 34 since the channels 33 also terminate below the flange 38 at the same elevation as the channels 35. As shown in dotted lines in FIG. 3, the lower ends of the channels 33 and 35 also terminate somewhat above the corresponding ends of the webs 36 whereby the vent passages 37 and 34 communicate at their lower ends with the temporary void 26, FIG. 2. The construction of the apparatus in FIGS. 3 to 6 is the same as disclosed in FIG. 2, although shown in greater detail. It should be clear that the venting or anti-vacuum passages 37 and 34 of the pusher 30 prevent the objectionable inward drawing of the soft soil surrounding the pusher, as shown in FIG. 1, resulting in the formation of defective piles. With the unique anti-vacuum feature of the present invention, there is no necessity for controlling the degree of penetration of the plow point 22 under each hammer blow, and thus this less expensive process can be used in more applications.

Figure 4:
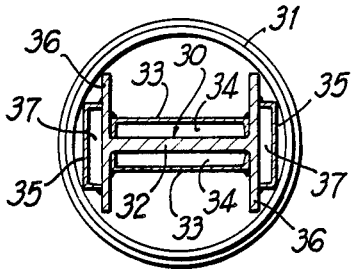
FIG. 4 a horizontal section taken on line 4—4 of FIG. 3.
Figure 5:
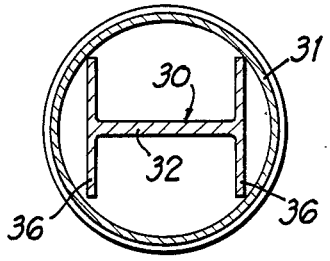
FIG. 5 is a similar section taken on line 5—5 of FIG. 3.
Figure 6:
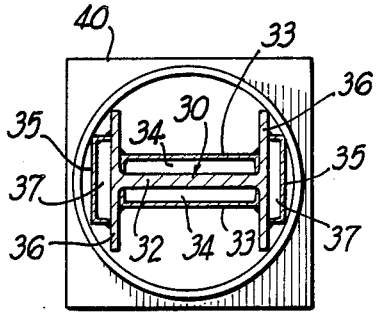
FIG. 6 is a view similar to FIG. 4 showing a different type of plow point.

FIG. 6 depicts the same apparatus structure shown in FIGS. 3–5 except that the plow point 39 has a square bottom plate 40 instead of a circular one as in FIGS. 3 to 5.

Figure 7:
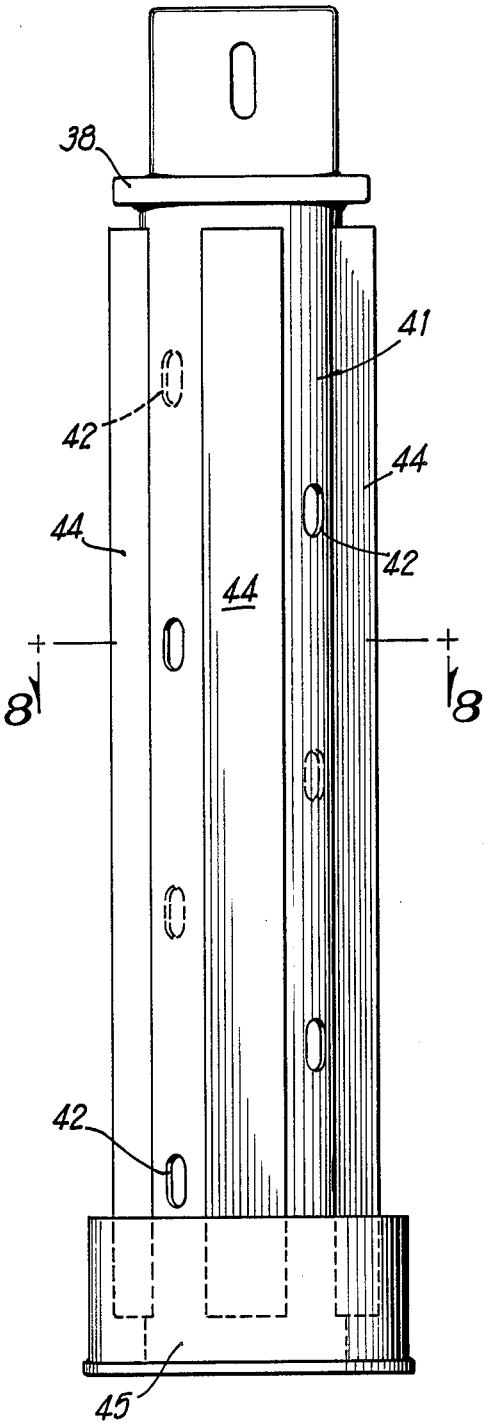
FIG. 7 is a side elevation of a pusher and plow point according to a second embodiment of the invention.
Figure 8:
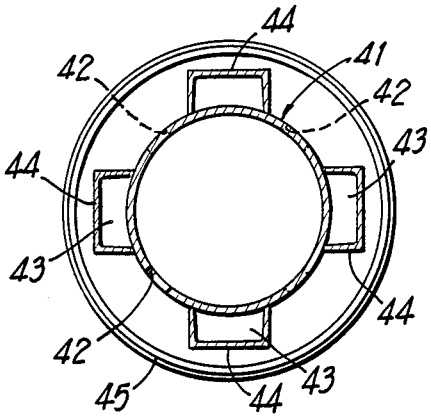
FIG. 8 is a horizontal section taken on line 8—8 of FIG. 7.
Figure 9:
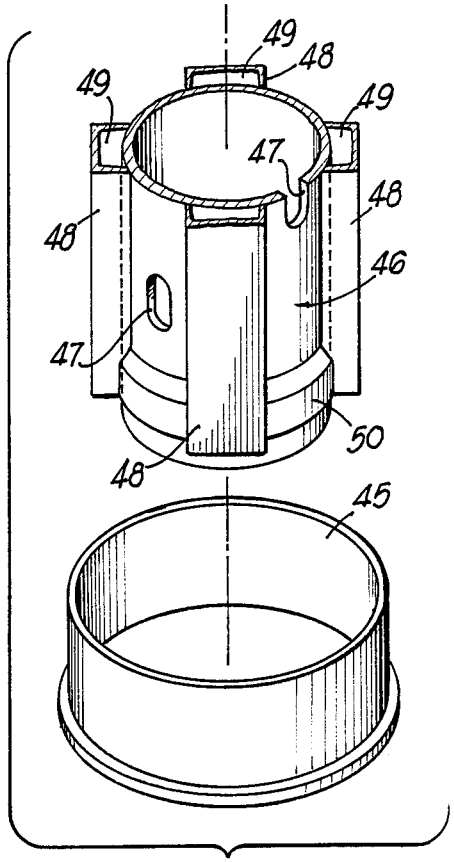
FIG. 9 is an exploded perspective view, partly in section, showing a pusher and plow point according to another embodiment of the invention.
Figure 10:
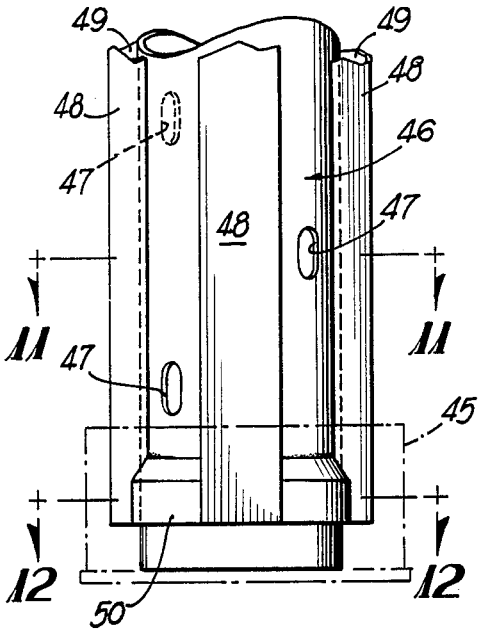
FIG. 10 is a fragmentary side elevation of the elements shown in FIG. 9 in assembled relationship.
Figure 12:
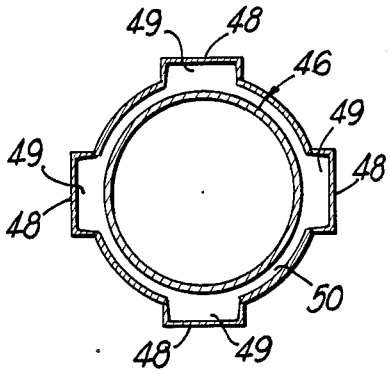
FIG. 12 is a similar view taken on line 12—12 of FIG. 10
Figure 11:
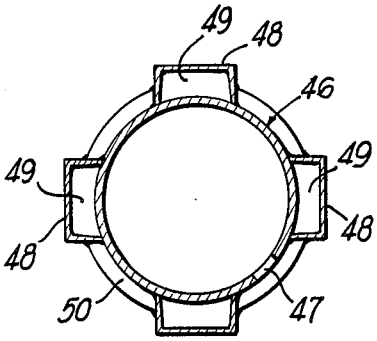
FIG. 11 is a horizontal section taken on line 11—11 of FIG. 10.

FIGS. 7 and 8 show a second embodiment of the invention in which a pusher 41 comprises a cylindrical tubular member having circumferentially spaced and longitudinally staggered side wall grout openings 42 distributed along its length. A plurality of external vacuum-relief passages 43 are formed longitudinally on the pusher 41 by circumferentially equidistantly spaced channel members 44 welded thereto and having their opposite ends open, as shown. The pusher 41 is employed in the process of installing a concrete pile along with a plow point 45, FIG. 7.

FIGS. 9 through 12 show another modified embodiment of the invention in which a cylindrical tubular pusher 46 having side wall openings 47 along its length is equipped with exterior longitudinal channel members 48 welded thereto and defining a corresponding number of vacuum-relief passages 49 longitudinally of the pusher 46. Near and slightly above the lower end of the tubular pusher 46, FIG. 10, an enlarged diameter circumferential venting air passage 50 surrounds the pusher 46 and communicates directly with the longitudinal vacuum-relief passages 49, as shown best in FIG. 12, near the lower ends of the latter. The channels 48 are open at their top and bottom ends. As in the prior forms of the invention, the vacuum-relief passage means 49 and 50 serve to vent the void 26, FIGS. 1 and 2, to the atmosphere at all times so as to avoid inward pulling of the soft soil around the pusher, as previously explained.

Figure 13:
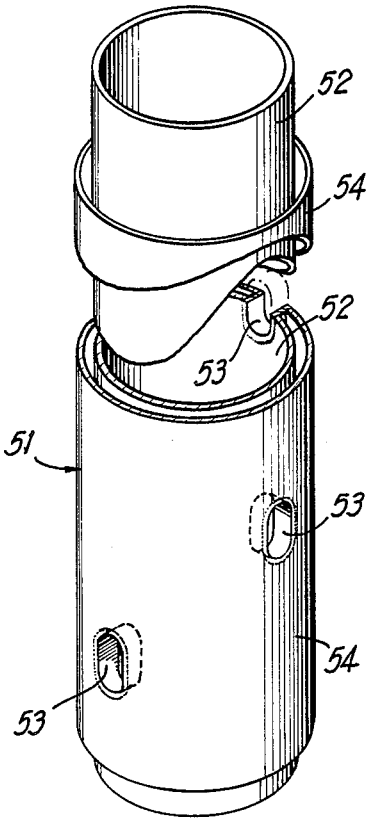
FIG. 13 is a perspective view, partly in section and partly broken away, showing another embodiment of the invention.
Figure 14:
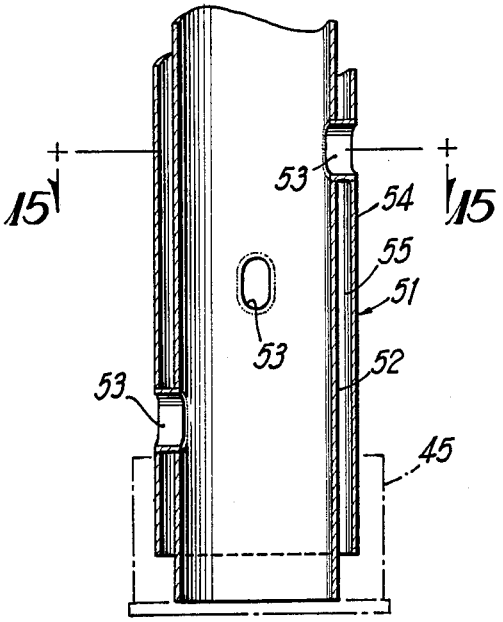
FIG. 14 is a fragmentary longitudinal vertical section taken through the apparatus in FIG. 13.
Figure 15:
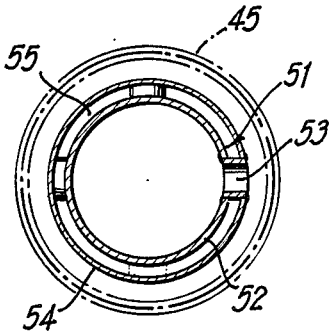
FIG. 15 is a horizontal section taken on line 15-15 of FIG. 14.

FIGS. 13 to 15 show yet another embodiment of the apparatus in which a pusher 51 comprises an inner tube body 52 having circumferentially spaced longitudinally staggered grout inlet openings defined by short sleeve sections 53 connected between the inner tube body 52 and a surrounding concentric outer tube 54. The annular space 55 between the two tubes 52 and 54 is the vacuum-relief or vent passage for the embodiment of the invention shown in FIGS. 13 to 15. Again, the operation of the apparatus according to FIGS. 13 to 15 in the practice of the method is identical to the operation of the preceding embodiments.

Figure 16:
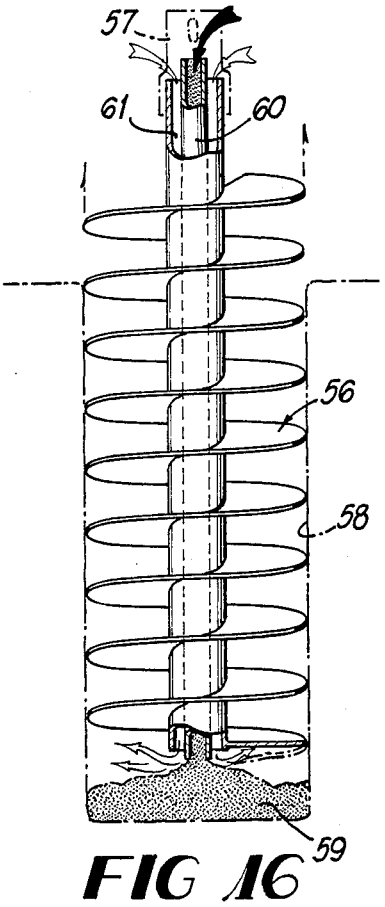
FIG. 16 is a side elevation, partly in section, showing an anti-vacuum auger-type pile installing apparatus according to another embodiment of the invention.
Figure 17:
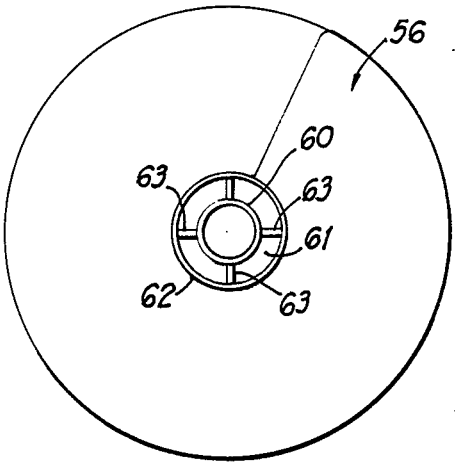
FIG. 17 is an end elevation of the apparatus shown in FIG. 16.

FIGS. 16 and 17 show another embodiment of the invention in which an auger 56 is driven in rotation by a means 57 to form a hole 58 while soil is elevated to ground level by the auger. As the auger is retracted upwardly from the hole 58, grout 59 to form a concrete pile within the hole 58 from bottom-to-top thereof is delivered downwardly through a central axial tube 60 of the auger 56. To relieve a vacuum which tends to be created beneath the auger as it is withdrawn from the hole 58, causing similar difficulties to those shown in FIG. 1, a vacuum-relief passage 61 extending lengthwise of the auger is formed by an open-ended tube 62 coaxially surrounding the tube 60 and being connected therewith by spaced struts 63. The benefits realized as a result of the vacuum-relief passage 61 are essentially the same as those realized by the relief passages described in the prior embodiments.

In the several embodiments of the invention shown in FIGS. 3 through 15 of the drawings, the pusher is withdrawn from the bore or hole in the soil at the completion of the process, but the plow point remains embedded in concrete at the bottom of the pile, as shown in U.S. Pat. Nos. 3,851,484 and 3,851,485. Each embodiment of the invention involves a soil penetrating device having a vacuum relief passage means as well as a passage means for grout. The H-cross section pusher 30 has grout passages on opposite sides of its center web 32 and between its side webs 36. The openings 42, 47 and 53 allow grout from the hopper 23 to pass from the exterior to the interior of the pusher 21 and from the interior to the exterior of the pusher 21 during the formation of the concrete pile. Following withdrawal of the pusher or auger, additional grout is delivered into the bore hole or opening to fill the space previously occupied by the pusher or auger, thus assuring the formation of a complete pile up to ground level.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A method of installing a concrete pile in soil comprising forming a substantially vertical opening in the soil below the surface of the soil by driving a pusher which is preceded by a plow point downwardly into the soil, simultaneously delivering grout into said opening to form the body of a concrete pile therein, and venting to the atmosphere the evacuated void which tends to develop in the opening being formed below the grout and between the grout and said plow point.

2. The method of claim 1, further comprising delivering the grout by gravity into the opening during the formation of the opening.

3. A method of installing a concrete pile in soil comprising forming a substantially vertical opening in the soil below the surface of the soil by augering the soil to form the opening, venting to the atmosphere the evacuated void which tends to devlop in the opening during the withdrawal of the augering means from the opening when the grout is being delivered into the opening during such withdrawal.

4. The method of claim 3, and said venting and the delivery of said grout both being carried out through passages of the augering means.

5. An apparatus for installing a concrete pile in soil comprising a device adapted to penetrate the soil to form a substantially vertical bore hole therein, means to fill the bore hole produced by the penetrating device with grout which flows into the bore hole as it is being formed, and a longitudinal atmospheric venting means on the device extending substantially from end-to-end thereof.

6. An apparatus for installing a concrete pile in soil as defined in claim 5, and said device comprising a pusher preceded by a plow point of somewhat greater cross-sectional size than the pusher, and said atomospheric venting means comprising means forming a longitudinal vent passage on the pusher extending substantially from end-to-end thereof.

7. An apparatus for installing a concrete pile in soil comprising an auger adapted to penetrate the soil to form a substantially vertical bore hole, a means to fill said bore hole with grout comprising a longitudinal grout passage means on the auger, and a venting means comprising a longitudinal venting passage on the auger for venting the evacuated void which tends to form as the auger is being removed as the grout flows into the hole.

8. An apparatus for installing a concrete pile in soil as defined in claim 7, and the longitudinal grout passage and venting passage comprising concentric passages through the auger axially near its center.

9. An apparatus for installing a concrete pile in soil as defined in claim 6, and the pusher comprising an H-cross section member, and means forming vent passage on and along the walls of the H-cross section member.

10. An apparatus for installing a concrete pile in soil as defined in claim 6, and the pusher comprising a tubular member having spaced side wall grout inlet openings, and said longitudinal vent passage on the pusher comprising at least one channel member fixed to the exterior of the tubular member.

11. An apparatus for installing a concrete pile in soil as defined in claim 10, and a plurality of circumferentially spaced channel members secured to the exterior of the tubular member, and means forming an annular venting passage on the exterior of the tubular member which communicates with the interiors of the channel members.

12. An apparatus for installing a concrete pile in soil as defined in claim 11, and the means forming said annular venting passage being located near the lower end of the tubular member.

13. An apparatus for installing a concrete pile in soil as defined in claim 6, and the pusher comprising a pair of spaced substantially concentric connected tube elements where the space between the tube elements forms said longitudinal vent passage.

14. An apparatus for installing a concrete pile comprising a device adapted to penetrate soil substantially vertically to form a pile receiving opening therein, means to fill said opening with fill material simultaneously during the formation of the opening by the device, and a vacuum-relief means on the device in the form of a vent passage extending longitudinally of the device.

15. An apparatus for installing a concrete pile as defined in claim 14, and said means to fill said opening with fill material including a fill material passage means in said device.

16. A method of installing a concrete pile comprising the steps of penetrating soil to form a pile receiving opening therein, delivering simultaneously flowable fill material into said opening to form the body of a pile therein, and relieving a vacuum which tends to be formed in said opening during the simultaneous formation of the opening and the delivery of the fill material into the opening.

* * * * *